United States Patent [19]

Koivusalo

[11] 4,190,925

[45] Mar. 4, 1980

[54] DOOR-CLOSER AND HINGE COMBINATION

[76] Inventor: Mauno K. Koivusalo, 20200 Turku 20, Finland

[21] Appl. No.: 894,081

[22] Filed: Apr. 4, 1978

[51] Int. Cl.[2] ..... E05F 3/20

[52] U.S. Cl. ..... 16/54; 16/50; 16/153

[58] Field of Search ..... 16/152, 153, 154, 49, 16/51, 57, 66, 50, 54,

[56] References Cited

U.S. PATENT DOCUMENTS

| | | | |
|---|---|---|---|
| 2,604,653 | 7/1952 | Anderson et al. | 16/154 |
| 3,098,258 | 7/1963 | Ruiz | 16/153 X |
| 3,707,014 | 12/1972 | Koivusalo | 16/52 |
| 3,748,688 | 7/1973 | Berkowitz | 16/153 |

*Primary Examiner*—George H. Krizmanich
*Attorney, Agent, or Firm*—Steinberg & Blake

[57] ABSTRACT

A door-closer and hinge combination includes a pair of hinge plates adapted respectively to be fixed to a door and door frame, these plates respectively carrying a pair of extensions which are situated along a predetermined hinge axis and which are formed with coaxial bores, the axis of which coincides with the hinge axis, these bores receiving a hinge pin for hingedly connecting the hinge plates to each other. An elongated force-transmittingrod extends parallel to the hinge axis and is guided by a pair of guide sleeves carried by one of the hinge plates for movement parallel to the hinge axis. The force-transmitting rod carries a helical cam-follower which cooperates with a cam slot formed in the other hinge plate, which does not carry the guide sleeves, this other hinge plate preferably being fixed to a door so that upon opening the door the rod is vertically displaced. A structure which is capable of storing a force is operatively connected with the force-transmitting rod to store a force while the force-transmitting rod is displaced in a door-opening direction during opening of a door, as a result of the coaction between the cam and cam-follower. Upon closing of the door, the force which is stored is utilized to act on the force-transmitting rod so that through the latter and the cam and cam-follower a closing force is provided on the door to urge the latter to a closed position.

15 Claims, 9 Drawing Figures

DOOR-CLOSER AND HINGE COMBINATION

BACKGROUND OF THE INVENTION

The present invention relates to a door-closer and hinge combination.

Thus, the structure of the invention includes a pair of hinge plates adapted respectively to be fixed to a door and door frame and interconnected by a hinge pin for hingedly connecting these hinge plates to each other. The door-closer part of the combination acts in the direction of the hinge axis with a force which is stored during opening of the door, this stored force being utilized during closing of the door to act through a cam and cam-follower structure on the door for urging the latter toward its closed position. The door-closer portion which responds to the stored force is carried by one of the hinge plates while the other of the hinge plates carry part of the cam structure. Thus, this other hinge plate can carry a suitable cam which cooperates with a cam-follower carried by an axially movable force-transmitting rod.

SUMMARY OF THE INVENTION

It is a general object of the present invention to further develop the combination of a door-closer and hinge combination disclosed in U.S. Pat. No. 3,707,014.

A more specific object of the present invention is to provide a combination of a door-closer and hinge which is exceedingly compact, while at the same time being simple and reliable in its operation.

Furthermore, it is an object of the present invention to provide a door-closer which is capable of being used for a number of different purposes such as for closing lift doors as well as doors manufactured from metal sections.

In order to achieve the above objects, one of the primary features of the invention resides in the fact that the hinge plate which carries the door-closer part of the combination is provided with a pair of guide sleeves in which a force-transmitting rod is guided for movement in a direction parallel to the hinge axis. Between these guide sleeves there is a space which receives a helical cam carried by that hinge plate which is fixed to a swingable door, and with this cam a cam-follower cooperates, the cam-follower being connected to the force-transmitting rod. A force means cooperates with this rod for storing a force when the rod is moved during opening of the door, the stored force acting on the rod during closing of the door to transmit a closing force to the door through the cam-follower and cam.

BRIEF DESCRIPTION OF DRAWINGS

The invention is illustrated by way of example in the accompanying drawings which form part of this application and in which.

DESCRIPTION OF PREFERRED EMBODIMENTS

Figure 1:
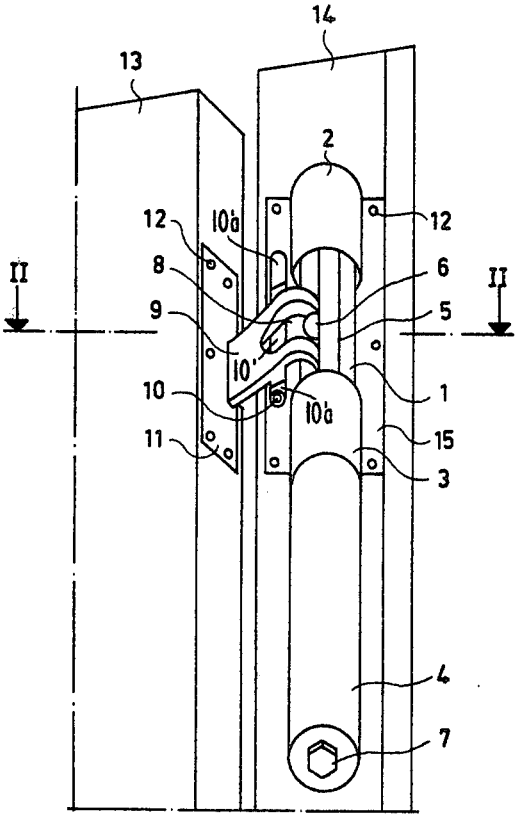
FIG. 1 is a perspective illustration of a door-closer and hinge combination according to the invention, the structure of FIG. 1 being situated at a lower part of a door and being shown as it appears when looking downwardly on the structure of FIG. 1 from above.
Figure 2:
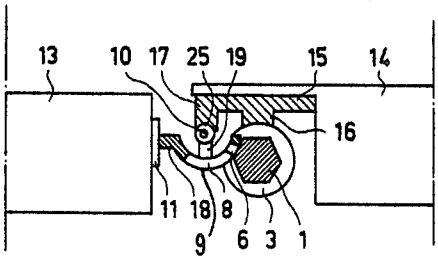
FIG. 2 is a transverse section of the structure of FIG. 1 taken along line II—II of FIG. 1 in the direction of the arrows.

Referring to FIGS. 1 and 2, there is shown therein a hinge plate means 11 which is adapted to be fixed, as by fastener screws 12, to a door 13. The other hinge plate means 15 of the door-closer and hinge combination of the invention is adapted to be fastened, also by fastener screws 12 or the like, to a door frame 14. The door 13 is shown in FIGS. 1 and 2 in its open position.

The hinge plate means 15 carries an extension means 17 which is shown in FIG. 2, while the hinge plate means 11 carries in a manner described below an extension means 19, and the pair of extension means 17 and 19 extend along a hinge axis and are formed with coaxial bore forming portions 10'a and 10', respectively the axis of the bores coinciding with the hinge axis, these axial bores receiving a hinge pin 10 so that by way of the extensions 17 and 19 and the hinge pin 10 in the bores of these extensions the pair of hinge plate means 11 and 15 are hingedly connected to each other, and thus the door 13 is swingable with respect to the door frame 14 about the axis of the hinge pin 10. It is thus seen in FIG. 1 that bore forming portion 10'a is integral with hinge plate means 15 through projection 17 (not seen in FIG. 1) while bore forming portion 10' is integral with hinge plate means 11 through projection 19 (also not seen in FIG. 1). Thus, the above structure forms the hinge part of the door-closer and hinge combination.

The door-closer part of the combination includes an elongated force-transmitting rod 1 which extends parallel to the hinge axis and which is of a polygonal cross section, as is apparent from FIG. 2. The force-transmitting rod means 1 is guided for longitudinal movement along its central rod axis by way of a guide means which includes a pair of guide sleeves 2 and 3, these sleeves being coaxial and spaced from each other. The sleeves 2 and 3 are fixedly carried by portions 16 of the hinge plate 15, these portions 16 projecting from the hinge plate 15 so that the coaxial guide sleeves 2 and 3 are spaced from that part of the hinge plate 15 which is fixed to the door frame 14. The guide sleeves 2 and 3 are formed with coaxial bores of the same cross section as the force-transmitting rod 1, so that the latter extends across the space between the sleeves 2 and 3 while being slidably received therein for longitudinal movement. Because of the non-circular cross section of the rod 1 and the guide bores which receive the same, the rod 1 cannot turn about its axis and can only move longitudinally along its axis.

The hinge plate means 11 which is fixed to the door 13 has an integral portion 18 extending therefrom and carrying a cam means 9 in the form of a curved wall forming part of a cylinder whose axis coincides with the hinge axis, this cam means 9 being formed with the camming slot 8 which is of a helical configuration, extending along a helix whose axis also coincides with the hinge axis. The cam means 9 is formed by a curved wall and the slot 8 therein cooperates with a cam-follower means 6 in the form of a roller supported for free rotation on a pin fixed to and extending from the force-transmitting rod 1, this roller 6 being situated at all times within the camming slot 8. It will be noted that the cam means 9 extends into the space defined between the guide sleeves 2 and 3 which form the guide means for the force-transmitting rod means 1.

A force means 4 is operatively connected with the force-transmitting rod means 1 to urge the latter in a door-closing direction, this force means 4 acting in a manner described below to store a force during the door-opening movement, this stored force being utilized during the door-closing movement to bring about closing of the door. The force means 4 is connected with and extends from the guide sleeve 3 in an upward direction, and FIG. 1 shows at the top of the force means 4 an adjusting means 7 which can be used for adjusting, at least in part, the force with which the force means acts. FIG. 1 illustrates the door-closer and hinge combination which is situated at the lower portion of the door as it appears when looking downwardly on the structure so that in this figure the force means 4 appears below guide sleeve 3. It is understood that in the case where a door-closer and hinge combination is situated at the upper portion of the door, the force means 4 extends from a corresponding guide sleeve 3 in a downward direction.

The extensions 19 terminate in circular portions 25 which are formed with the bores for the hinge pin 10, these extensions 19 projecting horizontally from upper and lower edge regions of the curved plate of the cam means 9, and the extensions 17 are respectively situated above and below the extensions 19 so that between the extensions 17 there is a space into which the curved cam plate 9 can turn during opening and closing movement of the door 13 which turns through 90° in a counterclockwise direction, as viewed in FIG. 2, from the illustrated open position to a closed position extending perpendicularly from the door frame 14. In the closed position of the door the hinge plate 11 is situated directly next to the guide sleeves 2 and 3.

The structure of the invention is shown schematically in FIGS. 1 and 2. An actual construction of the components of the invention which are respectively carried by the pair of hinge plate means 11 and 15 is illustrated in FIGS. 3–7.

Figure 3:
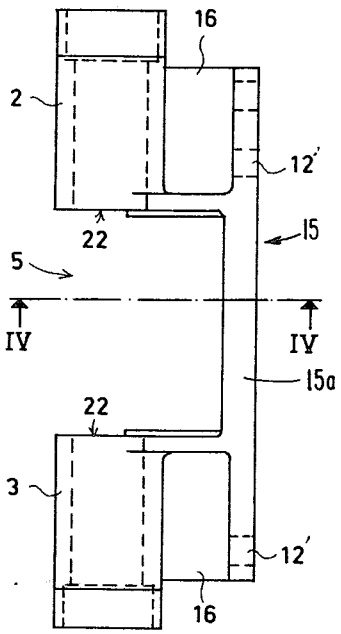
FIG. 3 is a side elevation of a hinge plate and structure carried thereby, the structure of FIG. 3 being connected to a door frame which is fragmentarily shown in FIGS. 1 and 2.
Figure 4:
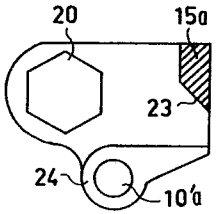
FIG. 4 is a transverse section of the structure of FIG. 3 taken along line IV—IV of FIG. 3 in the direction of the arrows.

Referring to FIGS. 3 and 4, the hinge plate means 15 which is attached to the door frame 14 includes the elongated end hinge plate or wall 15*a* which is integral with the projections 16 which respectively carry the guide sleeves 2 and 3 as described above. These guide sleeves 2 and 3 define between themselves the space 5 which extends along an intermediate portion of the end wall which forms the hinge plate means 15. The guide sleeves 2 and 3 terminate in inner end surfaces 22 which are normal to the hinge axis and which extend all the way up to the hinge plate or end wall 15*a*, this wall 15*a* being narrower at its portion which extends between the extensions 16 which carry the sleeves 2 and 3. This narrower portion of the wall 15*a* is formed with an inclined, bevelled surface 23, shown in FIG. 4, and forming part of the space 5. Thus this surface 23 of the wall 15 also extends parallel to the hinge axis. FIG. 4 clearly illustrates the non-circular cross section of the bore 20 of the guide sleeve 2, the guide sleeve 3 having a similar coaxial non-circular bore 20. In the illustrated example these bores 20 as well as the rod 1 are of a hexagonal configuration. Thus the force-transmitting rod means 1 can slide longitudinally in the bores 20 of the sleeves 2 and 3 but cannot turn about its rod axis.

Figure 7:
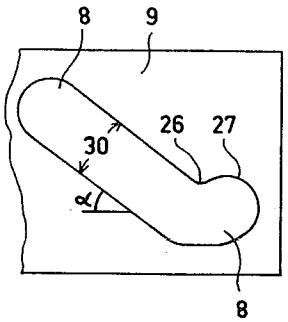
FIG. 7 is a developed view of a helical cam means of the invention, this cam means being shown in FIG. 7 also as it appears when looking downwardly from above so that orientation of a camming slot which is shown in FIG. 7 is the reverse of the orientation thereof which is shown in FIG. 5.
Figure 5:
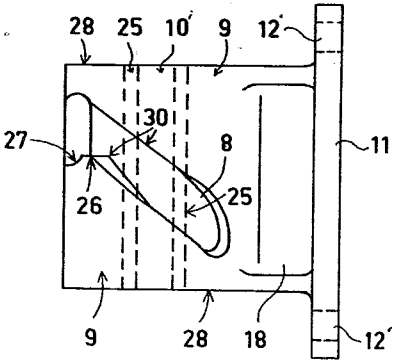
FIG. 5 is a side elevation of that part of the structure of FIGS. 1 and 2 which is connected to the door and which cooperates with the structure shown in FIG. 3.
Figure 6:
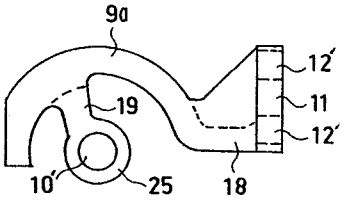
FIG. 6 is a plan view of the structure of FIG. 5 as seen when looking upwardly toward the bottom of the structure in FIG. 5.

FIGS. 5–7 illustrate details of the cam means 9 which is fixedly carried by the hinge plate means 11 which is formed with the bores 12′ for receiving the fasteners 12. In the same way the hinge plate means 15 is formed with bores 12′ for the fasteners 12. Thus, FIGS. 5 and 6 show the projection 18 integral with the hinge plate 11 and carrying the curved cam means 9 in the form of part of a cylinder wall whose axis coincides with the hinge axis as described above. FIGS. 5 and 7 illustrate the configuration of the helical slot 8 which extends through the curved wall 9 and which has the opposed helical camming surfaces 30 with which the cam-follower means 6 cooperates, this follower means 6 being in the form of a roller received in the slot 8 and cooperating with the camming surfaces 30. Of course these camming surfaces 30 extend along a helix whose axis coincides with the hinge axis. The inclination $\alpha$ of the helical camming surfaces 30 is illustrated in FIG. 7.

FIGS. 5 and 7 illustrate how the camming slot 8 is provided at one end with a short portion 26 which terminates in an end recess 27 adapted to receive the follower roller 6 for maintaining the door in its open position. The structure is shown in FIG. 7 as it appears when looking downwardly from above, so that the lower end of the camming slot 8 is shown at the upper left of FIG. 7, while the upper end thereof is shown at the lower right of FIG. 7. The orientation of the slot 8 in the assembly when used is illustrated in FIG. 5. In the open position of the door the roller 6 passes downwardly against the lower curved surface of the end recess 27 of the camming slot 8, and since this lower portion of the recess 27 extends below the lowermost part of the portion 26 of the slot 8, the door will be maintained in its open position. Thus, in order to close the door it is only necessary to move it manually with a force sufficient to displace the roller 6 out of the recess 27 and beyond the portion 26 of the slot 8, to be received in the inclined portion of the slot 8 between the camming surfaces 30, and then the force which is stored by the force means 4 will act to complete the closing of the door. The force is stored in the force means 4 during opening of the door, in a manner described in greater detail below.

FIG. 6 shows the extensions 19 which are integral with upper and lower portions of the cam means defined by curved wall 9*a* and which are provided with the coaxial circular portions or eyes 25 which form the openings 10′ for receiving the hinge pin 10. As is shown in dotted lines in FIG. 5 it is possible to provide an extension 19 which extends axially along the entire length of the curved wall 9*a*, behind the slot 8 thereof, so that in this case the circular portion 25 is in the form of an elongated tube which is formed with an axial bore 10'.

As is apparent from FIG. 4, the hinge plate means 15 in an actual construction, instead of having extensions 17, is provided with the protruding portions 24 which are formed with the coaxial bores 10'*a* forming extensions of the bores 10' of the extensions 19 when the parts are assembled. Thus the extension means 24 are integral with the projections 16 and extend outwardly from the space 5 to cooperate with the extensions 19 to provide a series of coaxial bore forming portions 10' and 10'*a* for receiving the hinge pin 10.

It will be noted from FIG. 5 that the curved plate of the cam means 9 terminates in a pair of opposed outer end faces 28 which are normal to the hinge axis, and these outer end surfaces 28 of the camming means 9 become situated directly next to the inner end surfaces 22 of the guide sleeves 2 and 3, when the parts are assembled with the cam means 9 situated in the space 5. Of course, when the parts are assembled the cam-follower roller 6 which is carried by the force-transmitting rod means 1 will be situated in the camming slot 8. It is thus apparent that the assembly of the invention provides an extremely compact, sturdy, long-lasting, and reliable door-closer and hinge combination.

Figure 8:
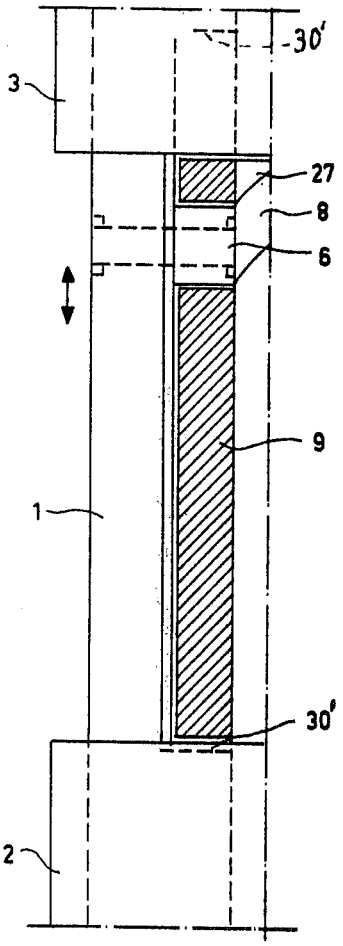
FIG. 8 is a partly sectional schematic elevation of a guide means and force-transmitting rod, showing further details of the structure illustrated in FIG. 1, at an enlarged scale as compared to FIG. 1.

Referring to FIG. 8, the cam means 9 is shown in a vertical section where the cam-follower roller 6 is situated in the camming slot 8, with the end recess 27 being schematically indicated at the upper end portion of the camming slot 8. The force-transmitting rod 1 is provided at an intermediate elongated portion therof, which extends between the guide sleeves 2 and 3, and partly into the guide sleeves 2 and 3, with a cross section which is less than the cross section of the opposed elongated end regions of the rod 1 which are situated within the guide sleeves 2 and 3. In this way the rod 1 is formed with an elongated recess defined between the shoulders 30' which face each other, and it will be seen that the cam means 9 extends into the space between these shoulders 30' to be situated along the elongated intermediate portion of the rod 1 which has the lesser cross-sectional area. Thus between the shoulders 30' the rod 1 is formed with an elongated recess the depth of which is approximately equal to one half the thickness of the rod 1, and the recess defined between the shoulders 30' is long enough and deep enough to receive the curved wall which forms the cam means 9 while at the same time permitting the rod 1 to move longitudinally with respect to this curved wall which only turns about the hinge axis during the opening and closing movement of the door. Thus the distance between the shoulders 30' is sufficiently great to enable the force-transmitting rod 1 to move vertically through the distance required to bring about opening and closing movement of the door through 90° about the hinge axis.

Figure 9:
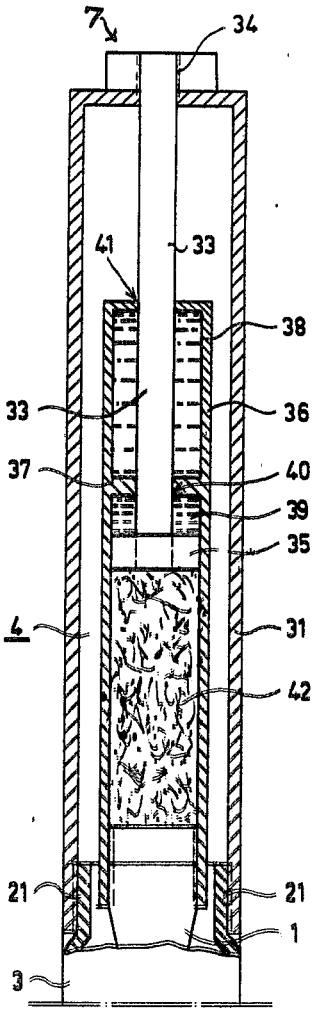
FIG. 9 is a sectional elevation of a force means of the invention which cooperates with a force-transmitting rod, the structure of FIG. 9 being an upward continuation of the structure which is illustrated in FIG. 8.

The details of one example of the force means 4 are illustrated in FIG. 9 which shows the structure which continues upwardly from the structure illustrated in FIG. 8. Thus, referring to FIG. 9 it will be seen that the upper guide sleeve 3 carries an outer cylindrical housing 31 which has at its lower inner portion interior threads which are threaded onto exterior threads at an upper portion 21 of the guide sleeve 3. This cylindrical housing 31 houses in its interior an elongated cylinder 36 which at its lower end region is threaded onto an upper end region of the force-transmitting rod means 1. Thus the cylinder 36 moves with the rod 1 in a direction parallel to the hinge axis. Within the cylinder 36 of the force means 4 is a fixed piston 35 which defines in the cylinder 36 with the upper end of the rod means 1 an internal space 42 in which there is situated a gas such as air adapted to act as a pneumatic spring. The fixed piston 35 is fixedly carried by a piston rod 33 which is threaded through the upper end wall of the cylinder housing 31 where the outer threaded portion of the rod 33 carries a lock nut forming part of the adjusting means 7 referred to above in connection with FIG. 1. Thus FIG. 9 shows the threaded portion 34 at the upper end region of the piston rod 33. The stiffness of the pneumatic spring formed by the gas within the space 42 can be regulated by loosening this lock nut and adjusting the position of the rod 33 with respect to the housing 31, while additional adjustment can be provided by the threaded connection between the cylinder 36 and the rod 1 as well as by the threaded connection of the housing 31 on the upper end 21 of the guide sleeve 3. Thus, any or all of these threaded connections may be utilized for adjusting the force means 4.

As the door is swung from its closed to its open position, the cam means 9 rotates about the axis defined by hinge pin 10, the cam slot 8 formed in the cam means 9 correspondingly rotating to thereby urge the cam-follower means 6 upwardly to raise the rod 1, so that the rod 1 approaches the fixed piston 35, and the volume of the space 42 diminishes so that the gas in the space 42 becomes compressed to store a force to be utilized during closing of the door. As was indicated above, the door can be maintained in its open position, even though the gas is compressed in the space 42, by coaction of the recess 27 with the roller 6. When the door is closed, the roller 6 will simply be displaced beyond the recess 27 into the inclined portion of the cam slot 8, so that now the force stored in the gas in the space 42 can be released, so that this stored force causes the gas in the space 42 to expand while the rod 1 and the cylinder 36 are moved downwardly, the roller 6 acting at this time on the lower surface of the slot 8 for turning the cam means 9 and the door 13 therewith in the door-closing direction until the door closes.

A damping means is provided for damping the operation of the force means 4. This damping means includes an inner wall 37 fixed to the cylinder 36 and situated in the interior thereof surrounding the piston rod 33 with a predetermined clearance space 40. Situated at the side of the piston 35 opposite from the space 42 is a damping fluid which may take the form of any suitable liquid such as a suitable oil, this damping fluid filling the spaces 38 and 39 on opposite sides of the wall 37 within the cylinder 36 at the side thereof opposite from the piston 35. Thus as the cylinder 36 moves with respect to the piston 35, the damping liquid will be throttled as it flows through the clearance gap 40 from one side to the other side of the wall 37, and in this way the movement of the rod 1 and the cylinder 36 therewith is damped. The top end of the cylinder 36 has a fluid-tight opening 41 through which the rod 33 passes.

Of course the invention is not to be restricted to the details set forth above, which have been provided by way of example only. The details of the invention of course may vary within the framework of the inventive concept as defined by the claims which follow.

Thus it will be understood that the structure of the invention can be located at an upper part of the door instead of at a lower part thereof, and two or more of the assemblies of the invention can be utilized for a single door, or if desired only one assembly as described above and shown in the drawings may be utilized, while the door may be connected to the door frame by one or more additional hinge parts which include only the hinge portions of the combination of the invention, the door-closer portion being omitted at the additional hinge part or parts. Furthermore, the recess 27 for co-operating with the roller 6 to retain the door in its open position may be omitted or if desired such a recess may be provided at each of the opposed ends of the camming slot 8 so that the door can be retained both in its open position and in its closed position by such a recess, if desired.

What is claimed is:

1. In a door-closer and hinge combination, a pair of hinge plate means respectively adapted to be fixed to a door and door frame, said pair of hinge plate means respectively fixedly carrying a pair of extension means which respectively extend from said pair of hinge plate means and which are situated along a predetermined hinge axis, said pair of extension means respectively being formed with coaxial bores having a common axis coinciding with said hinge axis, and a hinge pin situated in said coaxial bores so that through said pair of extension means said pair of hinge plate means are hingedly connected to each other to provide for turning of the hinge plate means connected to the door about said hinge axis with respect to the hinge plate means connected to the door frame, elongated force-transmitting rod means having a rod axis which is parallel to said hinge axis, guide means carried by one of said hinge plate means and cooperating with said rod means for guiding the latter for movement along said rod axis, said rod means and the other of said hinge plate means forming a pair of means one of which carries a cam means and the other of which carries a cam-follower means which cooperates with said cam means, said cam means extending along part of a cylinder whose axis coincides with said hinge axis and having a camming surface which extends along a helix whose axis coincides with said hinge axis, so that during turning of the hinge plate means connected to the door with respect to the hinge plate means connected to the door frame, about said hinge axis, said cam means and cam-follower means cooperate for displacing said rod means along said rod axis thereof in a door-opening direction during opening of a door and in an opposite axial direction along said rod axis in a door-closing direction during closing of a door, and force means operatively connected with said rod means for storing a force when said rod means moves in said door-opening direction and for delivering the stored force through said rod means and said cam means and cam-follower means to the hinge plate means which is connected to the door for providing a door-closing force when said force means acts on said rod means to displace the latter in said door-closing direction, so that when a door is opened a force for closing the door is stored at said force means and when the door is to be closed said stored force will be utilized for closing the door.

2. The combination of claim 1 and wherein said guide means is fixedly carried by that one of said hinge plate means which is adapted to be connected to the door frame.

3. The combination of claim 1 and wherein said guide means includes a pair of coaxial spaced guide sleeves fixedly carried by said one hinge plate means and having a common axis coinciding with said rod axis, said rod means being slidable in said sleeves.

4. The combination of claim 3 and wherein said sleeves define between themselves a space in which said cam means is situated.

5. The combination of claim 4 and wherein said pair of guide sleeves respectively terminate in inner end surfaces which face each other, which define said space therebetween, and which are normal to said rod axis, said cam means being operatively connected with that hinge plate means which is adapted to be connected to the door for turning movement therewith and said cam means terminating in a pair of outer end surfaces which are respectively situated next to said inner end surfaces of said sleeves and which are also respectively situated in planes normal to said rod axis.

6. The combination of claim 4 and wherein said one hinge plate means has an end wall extending parallel to the hinge axis and adapted to be fixed by suitable fasteners to a component such as a door or door-frame, said sleeves terminating in inner end surfaces which define said space between themselves and said inner end surfaces of said sleeves being normal to said rod axis and extending from said sleeves up to said end wall while having a width greater than said end wall, and said end wall having an inclined bevelled surface which extends between said end surfaces for defining part of said space for accommodating said cam means and cam-follower means.

7. The combination of claim 1 and wherein said cam means includes a cylindrical wall extending along a cylinder whose axis coincides with said hinge axis and said cylindrical wall being formed with a helical slot which extends along said helix, said cam-follower means being situated in said slot.

8. The combination of claim 7 and wherein said cam means is fixedly carried by the hinge plate means which is connected to the door while the cam-follower means is carried by said rod means.

9. The combination of claim 4 and wherein bores of said guide sleeves have a non-circular cross section while said rod means has a mating non-circular cross section so that while said rod means is guided in said sleeves for movement along said rod axis said rod means cannot turn with respect to said sleeves.

10. The combination of claim 1 and wherein said cam means is carried by the hinge plate means which is adapted to be connected to the turnable door, and said cam means including a cylindrical wall forming part of a cylinder whose axis coincides with said hinge axis, said cylindrical wall being formed with a helical slot extending along said helix, said rod means having an elongated intermediate portion of a lesser cross-sectional area than the remainder of said rod means, and said intermediate portion of said rod means carrying a roller which forms said cam-follower means and which is situated in said slot, said cam means extending along said elongated intermediate portion of said rod means.

11. The combination of claim 1 and wherein that hinge plate means which is adapted to be connected to a door is turnable between a pair of end positions respectively corresponding to fully open and fully closed door positions, and said cam means having at least at one end a configuration for cooperating with said cam-follower means for maintaining the hinge plate means which is adapted to be connected to the door, and a door connected thereto, in one of said end positions.

12. The combination of claim 11 and wherein said end position is that position corresponding to the fully open position of the door.

13. The combination of claim 1 and wherein said force means includes a cylinder fixed at one end region to an end region of said rod means and extending longitudinally beyond said rod means while being movable therewith, said rod means closing said cylinder at one end thereof, and a piston fixed to said guide means and situated within said cylinder so that the latter slides longitudinally with respect to said piston during movement of said rod means along said rod axis, said piston defining with said rod means in said cylinder a hollow space containing a compressible gas, and said rod means when moving in said door-opening direction advancing toward said piston for reducing the volume of said space in said cylinder between said rod means and piston for compressing said gas and storing thereby the force which is utilized to urge the rod means away from the piston when the rod means is moved in said door-closing direction.

14. The combination of claim 13 and wherein a damping means is operatively connected with said cylinder for damping the movement thereof with respect to said piston.

15. The combination of claim 14 and wherein said damping means includes an elongated portion of said cylinder which extends to the side of said piston opposite from said rod means, a fixed piston rod being fixed to said piston and extending therefrom through said elongated portion of said cylinder, said elongated portion of said cylinder containing a damping fluid and fixedly carrying at the side of said piston opposite from said rod means a wall which surrounds said piston rod with a given clearance defining a throttling gap through which the damping fluid flows from one side to the other side of said wall during travel of said wall along said piston rod while said cylinder moves with said rod means along said rod axis.

* * * * *